United States Patent [19]

Hasebe et al.

[11] Patent Number: 4,774,920

[45] Date of Patent: Oct. 4, 1988

[54] IDLING SPEED CONTROL SYSTEM FOR INTERNAL COMBUSTION ENGINES

[75] Inventors: Hiroshi Hasebe, Hatogaya; Masahiko Asakura, Tokorozawa; Michio Sakaino, Fujimi; Yukio Miyashita, Hannou, all of Japan

[73] Assignee: Honda Giken Kogyo K. K. (Honda Motor Co., Ltd. in English), Tokyo, Japan

[21] Appl. No.: 880,686

[22] Filed: Jul. 1, 1986

[30] Foreign Application Priority Data

Jul. 5, 1985 [JP] Japan ..... 60-146603

[51] Int. Cl.[4] ..... F02D 41/16

[52] U.S. Cl. ..... 123/339; 123/360

[58] Field of Search ..... 123/339, 340, 354, 360, 123/352

[56] References Cited

U.S. PATENT DOCUMENTS

| | | | |
|---|---|---|---|
| 3,356,081 | 12/1967 | Dennis | 123/354 |
| 4,376,427 | 3/1983 | Mizuno | 123/339 |
| 4,462,355 | 7/1984 | Ozaki | 123/339 |
| 4,479,472 | 10/1984 | Shimamura | 123/339 |
| 4,522,175 | 6/1985 | Kamifuji | 123/339 |
| 4,546,744 | 10/1985 | Bonfiglioli | 123/339 |
| 4,572,141 | 2/1986 | Hasegawa | 123/339 |
| 4,617,890 | 10/1986 | Kobayashi | 123/339 |
| 4,625,281 | 11/1986 | Deutsch | 123/339 |
| 4,649,878 | 3/1987 | Otobe | 123/339 |

*Primary Examiner*—Ronald B. Cox

*Attorney, Agent, or Firm*—Arthur L. Lessler

[57] ABSTRACT

An idling speed control system for controlling idling rotational speed of an internal combustion engine. A vacuum-operated actuator having a diaphragm defining a vacuum chamber controls opening and closing of a throttle valve in response to pressures supplied from a change-over control valve to the vacuum chamber. The change-over control valve selectively supplies the vacuum chamber with a first control pressure for opening the throttle valve and a second control pressure for closing same. An electronic control unit generates an on-off control pulse signal having a pulse repetition period corresponding to rotational speed of the engine, one of on-period or off-period of the on-off control pulse signal having a predetermined constant value, and supplies the change-over control valve with the on-off control pulse signal. A valve opening-correcting device is operatively connected to the throttle valve and responsive to at least one predetermined external load applied on the engine for correcting to a larger opening the opening of the throttle valve which is determined by the change-over control valve in response to the on-off control pulse signal.

6 Claims, 2 Drawing Sheets

IDLING SPEED CONTROL SYSTEM FOR INTERNAL COMBUSTION ENGINES

BACKGROUND OF THE INVENTION

This invention relates to an idling speed control system for internal combustion engines, and more particularly to a system of this kind which is capable of stabilizing the rotational speed of the engine at idle by controlling the quantity of intake air supplied to the engine.

An internal combustion engine for automotive vehicles is so constructed that the output power and rotational speed thereof are controlled by controlling the quantity of intake air by the use of a throttle valve. In an engine having a carburetor, a throttle valve is generally mounted in the carburetor and so arranged that the opening thereof can be adjusted by an idling opening adjusting bolt screwed in the body of the carburetor. The idling opening of the throttle valve is adjusted, by the use of the idling opening adjusting bolt, to a suitable value at the time of manufacture or maintenance operation of the engine, and therefore the idling opening thus set by the bolt cannot be arbitrarily further adjusted by a driver during operation of the engine.

Since the idling opening of the throttle valve thus has an adjusted fixed value, the rotational speed of the engine is kept constant, if the load on the engine does not vary during idling operation of the engine. However, if the load on the engine varies due to variations in the load on the generator for charging the battery or in the load on the automatic transmission, or due to switching-on and -off of the compressor in the air-conditioner, the rotational speed of the engine correspondingly varies, which makes it difficult to obtain stable idling speed and sometimes results in engine stalling. It is therefore necessary to set a desired idling speed at such a high value as to keep the engine always operating in a stable idling condition, without being influenced by the variations in the engine load. However, if the desired idling speed is set at such a high value, there can occur problems such as occurrence of large noise during idling operation of the engine, and increase of the fuel consumption.

To solve such problems, it has conventionally been proposed e.g. by Japanese Provisional Patent Publication 58-155255 to control the throttle valve opening during idling operation of the engine by the use of a pulse motor. Another method of controlling the idling speed of the engine has been proposed by Japanese Provisional Patent Publication 59-155547, which comprises detecting the rotational speed of the engine by the use of a predetermined crank angle signal, calculating the difference between the detected engine rotational speed and a desired idling speed, and controlling the quantity of intake air bypassing the throttle valve by controlling the duty ratio of a control valve with a control signal corresponding to the difference thus calculated, so as to attain the desired idling speed.

The above proposed methods, however, require complicated control systems as well as expensive control devices and control valves, and thereby are not practical.

SUMMARY OF THE INVENTION

It is an object of the invention to provide an idling speed control system which is simple in construction and can be manufactured at a low cost.

It is a further object of the invention to assure stable engine operation without a drop in the idling speed of the engine when an external load is applied on the engine at idle, to thereby improve the driveability.

It is another object of the invention to correct the idling speed of the engine through multiple stages using different correction amounts dependent upon the magnitudes of external loads applied on the engine.

According to the invention, the foregoing object is attained by providing an idling speed control system for controlling idling rotational speed of an internal combustion engine having an intake passage and a throttle valve arranged therein, comprising: vacuum-operated actuator means having a vacuum chamber, and a diaphragm defining the vacuum chamber and operatively connected to the throttle valve for controlling opening and closing thereof in response to pressure in the vacuum chamber; change-over control valve means operatively connected to the vacuum-operated actuator means for supplying the vacuum chamber, selectively, with a first control pressure for opening the throttle valve and a second control pressure for closing the throttle valve; electronic control means operatively connected to the engine and the change-over control valve means, the electronic control means being adapted to generate an on-off control pulse signal having a pulse repetition period corresponding to rotational speed of the engine, one of on-period and off-period of the on-off control pulse signal having a predetermined constant value, and to supply the change-over control valve means with the on-off control pulse signal, in response to which the change-over control valve means supplies the vacuum chamber, selectively, with the first control pressure and the second control pressure; and valve opening-correcting means operatively connected to the throttle valve, and being responsive to at least one predetermined external load applied on the engine for correcting to a larger opening the opening of the throttle valve which is determined by the change-over control valve means in response to the on-off control pulse signal.

Preferably, the valve opening-correcting means comprises first means responsive to at least one first external load applied on the engine for increasing the opening of the throttle valve which is determined by the change-over control valve means, and second means responsive to at least one second external load applied on the engine which is greater than the first external load for additionally increasing the opening of the throttle valve which is determined by the first means.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
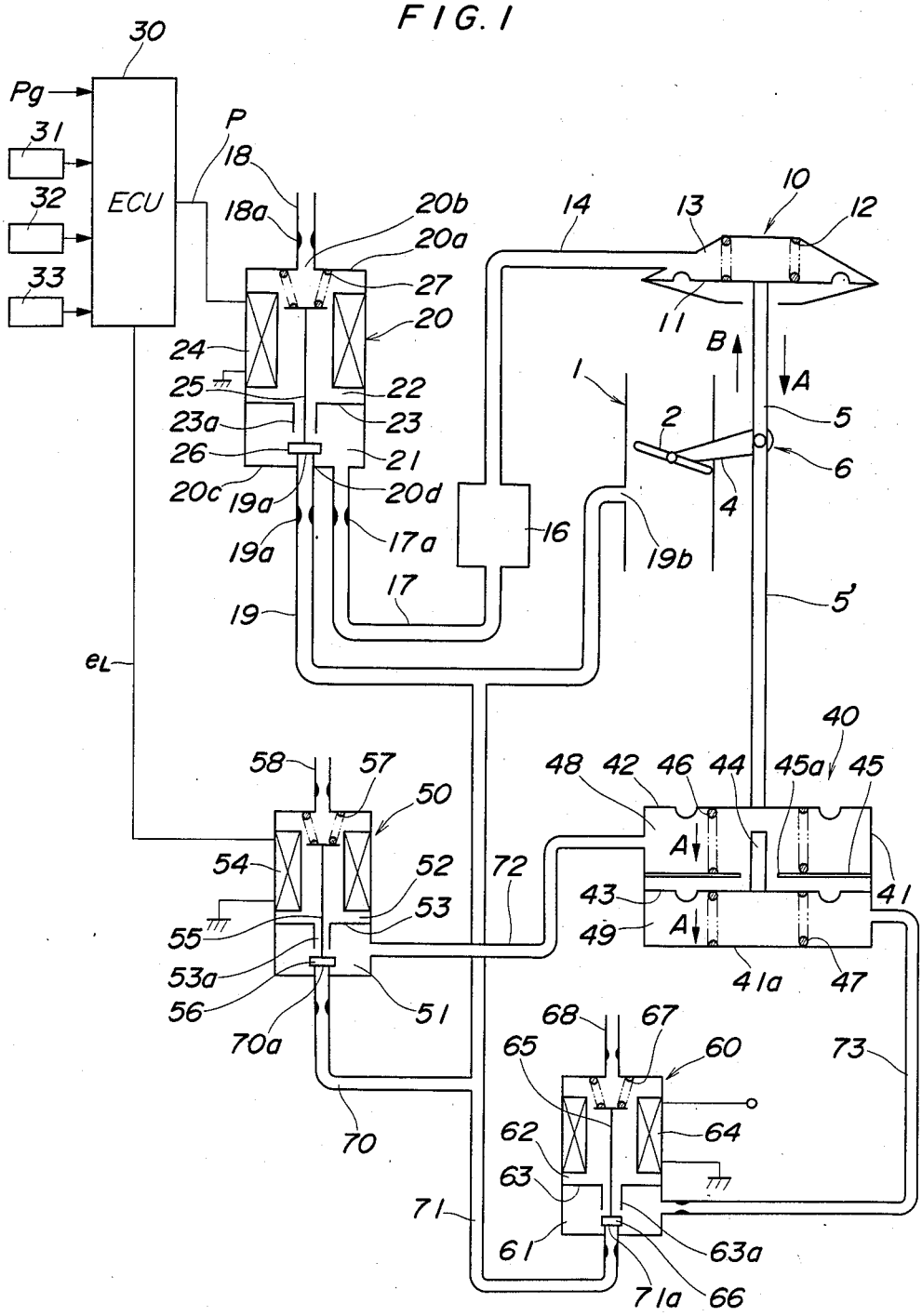
FIG. 1 is a schematic view illustrating the whole arrangement of an idling speed control system for internal combustion engines according to an embodiment of the invention.

Referring now to FIG. 1, there is illustrated the whole arrangement of an idling speed control system according to the invention. Reference numeral 1 designates an intake pipe, one end of which is connected to intake ports, not shown, of the engine, and the other end of which is connected to the atmosphere via an air cleaner, not shown. Arranged in the intake pipe 1 is a throttle valve 2 which is connected to a pneumatic actuator 10 by way of a link mechanism 6 comprising a lever 4 and a rod 5, and the opening of the throttle valve 2 is adjusted by the actuator 10 so that the engine rotational speed approaches a desired idling speed when the engine is operating in an idling condition.

The vacuum-operated actuator 10 is a push type which comprises a diaphragm 11, a vacuum chamber 13, and a coil spring 12. The vacuum chamber 13 communicates with a change-over control valve (hereinafter simply called "the solenoid valve") 20 comprising e.g. a frequency solenoid valve, through a passage 14, a surging tank 16 for suppressing sharp fluctuations in pressure, and a passage 17. On the other hand, the diaphragm 11 is connected to the rod 5.

The solenoid valve 20 is an on-off type, of which a solenoid 24 is energized or deenergized in response to a control signal from an electronic control unit (hereinafter simply called "the ECU") 30. When the solenoid 24 is energized, a vacuum or negative pressure produced in the intake pipe 1 is introduced into the vacuum chamber 13 in the actuator 10, and when the solenoid 24 is deenergized, the atmospheric pressure is introduced into the vacuum chamber 13.

To be specific, the solenoid valve 20 has two chambers 21 and 22 separated by a partition wall 23 and communicating with each other through a communication port 23*a* provided centrarlly of the partition wall 23. The chamber 22 also communicates with the atmosphere by way of a passage 18 connected to a hole 20*d* formed in an end wall 20*a* of the chamber 22. One end 19*a* of a passage 19 is hermetically inserted into a hole 20*d* formed in an end wall 20*c* of the chamber 21 centrally thereof. The open end 19*a* of the passage 19 projects into the chamber 21 and is opposed to the communication port 23*a* in the partition wall 23 with a predetermined gap, and the other open end 19*b* communicates with the intake pipe 1 at a predetermined location downstream of the throttle valve 2.

A plunger 25 axially movably extends through the solenoid 24 which is accommodated within the chamber 22 in the solenoid valve 20, with one end thereof slidably projected into the chamber 21 through the communication port 23*a*. A valve body 26 is secured to a face of the projected end of the plunger 25, and interposed between the communication port 23*a* and the open end 19*a* of the passage 19 such that it selectively closes the opposed open end of the communication port 23*a* or the open end 19*a* of the passage 19 in response to movement of the plunger 25. A return spring 27 is interposed in a contracted state between the other end of the plunger 25 and the opposed end wall 20*a* of the solenoid valve 20 such that it urges the plunger 25 in the direction in which the plunger projects into the chamber 21. The valve body 26 is urged against the open end 19*a* of the passage 19 by the return spring 27 when the solenoid 24 is deenergized, thereby closing the passage 19. The solenoid 24 has one connection terminal electrically connected to the ECU 30, and the other connection terminal grounded.

Incidentally, the passages 17, 18, and 19 communicating with the solenoid valve 20 are provided therein respectively with restrictions 17*a*, 18*a*, and 19*c* at predetermined locations thereof for restricting fluctuations in pressure within respective passages which are to be introduced into the chambers 21, 22 of the solenoid valve 20.

Reference numeral 40 designates a vacuum-operated actuator comprising, for instance, a two-stage type diaphragm device which has a cylindrical casing 41 with an open end and a closed opposite end having a bottom 41*a*. Diaphragms 42 and 43 are provided across the casing 41, the former at the open end and the latter halfway between the open end and the closed end, respectively. Secured across the casing 41 at a predetermined location between these diaphragms 42 and 43 and closer to the latter is a fixed wall 45 with a through hole 45*a* formed therein at the center thereof. The diaphragms 42, 43 and the fixed wall 45 cooperate to define, within the case 41, a first vacuum chamber 48 between the two diaphragms 42 and 43, and a second vacuum chamber 49 between the diaphragm 43 and the casing bottom 41*a*, respectively. The fixed wall 45 is located close to the diaphragm 43 so as to prevent the diaphragm 43 from being displaced toward the first vacuum chamber 48 through a large distance, i.e. beyond the fixed wall 45 when a negative pressure is applied to the first vacuum chamber 48. A movable stopper 44 is secured at its one end to a central portion of the diaphragm 43, and extends through the hole 45*a* for free movement therethrough, and the other end of the movable stopper 44 is opposed to the inner side surface of the diaphragm 42 with a gap therebetween. A diaphragm spring 46 is interposed in a contracted state between the diaphragm 42 and the fixed wall 45, and similarly a diaphragm spring 47 between the diaphragm 43 and the bottom 41*a* of the case 41. An extended portion 5' of the rod 5 has its one end connected to the lever 4 via a pin 80 in such a manner that the lever 4 can rotate about the pin 80, and has the other end secured to a central portion of the outer side surface of the diaphragm 42. Thus, the portion 5' forms an element of the link mechanism 6.

The first and second vacuum chambers 48, 49 of the vacuum-operated actuator 40 are in communication, respectively, with solenoid valves 50, 60, which will be described hereinafter. The actuator 40 and the solenoid valves 50, 60 form valve opening-correcting means having functions described hereinafter.

Like the solenoid valve 20, the solenoid valve 50 is an on-off type electromagnetic valve, and has two chambers 51 and 52 separated by a partition wall 53 and communicating with each other via a communication port 53*a* formed at the center of the partition wall 53. The chamber 52 also communicates with the atmosphere by way of a passage 58 connected to a hole formed in an end wall of the chamber 52. One end 70*a* of a passage 70 hermetically penetrates through a hole formed in the other end wall of the chamber 51 centrally thereof. The open end 70*a* of the passage 70 projects into the chamber 51 and is opposed to the communication port 53*a* on the partition wall 53 with a predetermined gap therethrough, and the other open end of the passage 70 communicates with a passage 71 which in turn communicates with the passage 19. The chamber 51 communicates with the first vacuum chamber 48 of the vacuum-operated actuator 40 via a passage 72.

A plunger 55 axially movably extends through a solenoid 54 which is accommodated within the chamber 52 in the solenoid valve 50, with one end thereof projected into the chamber 51 through the communication port 53*a*. A valve body 56 is secured to the projected end of the plunger 55, and interposed between the communication port 53*a* and the open end 70*a* of the passage 70 such that it selectively closes the opposed open end of the communication port 53*a* or the open end 70*a* of the passage 70 in response to movement of the plunger 55. A return spring 57 is interposed in a contracted state between the other end of the plunger 55 and the opposed end wall of the solenoid valve 50 such that it urges the plunger 55 in the direction in which the plunger projects into the chamber 51. The valve body 56 is urged against the open end 70*a* of the passage 70 by the return spring 57 when the solenoid 54 is deenergized, thereby closing the passage 70. The solenoid 54 has one connection terminal electrically connected to the ECU 30, and the other connection terminal grounded.

Like the solenoid valve 20, the solenoid valve 60 is also an on-off type electromagnetic valve, and has two chambers 61 and 62 separated by a partition wall 63 and communicating with each other via a communication port 63*a* formed at the center of the partition wall 63. The chamber 62 also communicates with the atmosphere by way of a passage 68 connected to a hole formed in an end wall of the chamber 62. One end 71*a* of a passage 71 hermetically penetrates through a hole formed in the other end wall of the chamber 61 centrally thereof. The open end 71*a* of the passage 71 projects into the chamber 61 and is opposed to the communication port 63*a* on the partition wall 63 with a predetermined gap therebetween, and the other open end of the passage 71 communicates with the passage 19. The chamber 61 communicates with the second vacuum chamber 49 of the vacuum-operated actuator 40 via a passage 73.

A plunger 65 axially movably extends through a solenoid 64 which is accommodated within the chamber 62 in the solenoid valve 60, with one end thereof projected into the chamber 61 through the communication port 63*a*. A valve body 66 is secured to the projected end of the plunger 55, and interposed between the communication port 63*a* and the open end 71*a* of the passage 71 such that it selectively closes the opposed open end of the communication port 63*a* or the open end 71*a* of the passage 71 in response to movement of the plunger 65. A return spring 67 is interposed in a contracted state between the other end of the plunger 65 and the opposed end wall of the solenoid valve 60 such that it urges the plunger 65 in the direction in which the plunger projects into the chamber 61. The valve body 66 is urged against the open end 71*a* of the passage 71 by the return spring 67 when the solenoid 64 is deenergized, thereby closing the passage 71. The solenoid 64 has one connection terminal electrically connected to a control circuit (not shown) which is arranged to energize the solenoid 64 only when a compressor of an air-conditioner (not shown) is operating, and the other connection terminal grounded.

Reference is now made to how the control pulse signal P is generated from the ECU 30.

Figure 2:
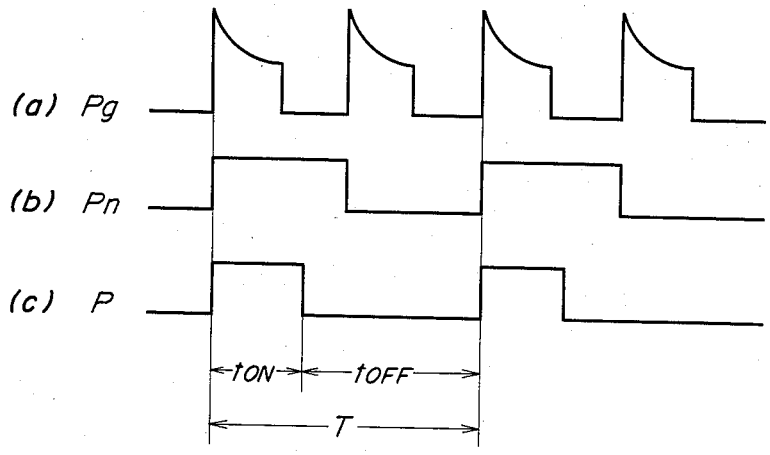
FIG. 2 is a graph showing waveforms of a control pulse signal P generated from an electronic control unit appearing in FIG. 1 on the basis of the period of an ignition pulse signal Pg for on-off control of a solenoid valve of the idling speed control system, as well as corresponding processed pulses.

When the engine is not loaded, the ECU 30 is supplied with the ignition pulse signal Pg generated from the primary winding of the ignition coil [(a) of FIG. 2] in synchronism with the engine rotation. The ignition pulse signal Pg has its frequency divided by a predetermined number N, e.g. two, to obtain a pulse signal Pn [(b) of FIG. 2]. Then, the ECU 30 generates a control pulse signal P [(c) of FIG. 2] which is at a high level for a predetermined fixed time period tON from the leading edge of each pulse of the pulse signal Pn. The pulse repetition period T of this control pulse signal P is equal to that of the pulse signal Pn, wherein the solenoid 24 is energized for the predetermined fixed time period tON and then deenergized for a time period tOFF (=T−tON).

Further, when the electronic control unit 30 is supplied with a signal representing some external load on the engine from an electrical load detector 31, a power transmission detector 32, or a low water temperature detector 33, hereinafter referred to, it outputs a load detection signal eL to the solenoid 54 of the solenoid valve 50. The electrical load detector 31 detects on-off states of electric devices such as headlights, and outputs a load signal indicative of the detected on-off states. The power transmission detector 32 detects on-off states of an electromagnetic clutch, now shown, which connects and disconnects the compressor of the air-conditioner with and from the engine, or a signal indicating that the automatic transmission assumes a position other than a neutral position and a parking position, and then outputs a load signal indicative of the on-off ttates or position. The low water temperature detector 33 is actuated to output a signal when the cooling water temperature TW is lower than a predetermined value.

The solenoid valve 20 operates such that when the solenoid 24 is deenergized by the control pulse signal P supplied from the ECU 30, the plunger 25 is biased by the force of the spring 27 toward the vacuum chamber 21 so that the valve body 26 closes the open end 19*a* of the passage 19 and opens the communication port 23*a*. On the other hand, when the solenoid 24 is energized by the control pulse signal P, the plunger 25 is attracted by a magnetic force produced by the solenoid 24 and overcoming the urging force of the spring 27, to close the communication port 23*a* and open the open end 19*a* of the passage 19.

The duty ratio of control pulse signal P supplied to the solenoid 24 of the solenoid valve 20, which determines the opening period ratio between the passage 19 and the communication port 23*a*, varies with the pulse repetition period T of the same signal P. The pulse repetition period T of the control pulse signal P in turn varies with the frequency of the ignition pulse Pg, which is a function of the engine rotational speed Ne. Therefore, the duty ratio of the solenoid valve 20 varies in response to the engine rotational speed Ne. To be specific, as described above, the on-period or pulse duration tON of the pulse signal P [(c) of FIG. 2] is set at a predetermined constant value, and the off-period tOFF becomes longer as the engine rotational speed Ne decreases, and vice versa.

The solenoid valve 50 operates such that when the solenoid 54 is deenergized, the plunger 55 is biased by the force of the spring 57 toward the vacuum chamber 51 so that the valve body 56 closes the open end 70*a* of the passage 70 and opens the communication port 53*a*. On the other hand, when the solenoid 54 is energized, the plunger 25 is attracted by a magnetic force produced by the solenoid 54 and overcoming the urging force of the spring 57, to close the communication port 53*a* and open the open end 70*a* of the passage 70.

Similarly, the solenoid valve 60 is arranged such that when the solenoid 64 is deenergized, the plunger 65 is biased by the force of the spring 67 toward the vacuum chamber 61 so that the valve body 66 closes the open end 71*a* of the passage 71 and opens the communication port 63*a*, and when the solenoid 64 is energized, the plunger 65 is attracted by a magnetic force produced by the solenoid 64, and overcoming the urging force of the spring 67, to close the communication port 63*a* and open the open end 71*a* of the passage 71. The solenoid 64 is energized when the compressor of the air-conditioner is actuated.

Next, the operation of the system as described above will be explained.

As the engine rotational speed Ne at idle decreases, the pulse repetition period T of the control pulse signal P [(c) of FIG. 2] is increased, as explained above, and since the on-period tON is constant the off-period tOFF is increased by an amount corresponding to the decrease of the rotational speed Ne. As a result, the opening period of the communication port 23*a* in the solenoid 20 which communicates with the atmosphere becomes longer, in response to which the negative pressure in the vacuum chamber 13 becomes smaller, so that the diaphragm 11 is displaced by the urging force of the spring 12 to move the rod 5 along the arrow A and thereby open the throttle valve 2. Then, the engine rotational speed Ne increases according to the longer opening action of the throttle valve 2. On the other hand, as the engine rotational speed Ne increases, the opening period of the communication port 23*a* in the solenoid valve 20 becomes shorter, and then the negative pressure PB in the intake pipe becomes higher. As a result, a high negative pressure is introduced into the vacuum chamber 13 of the vacuum-operated actuator 10 and accordingly the negative pressure therein becomes larger, so that the diaphragm 11 is attracted by the higher negative pressure in the vacuum chamber 13 against the urging force in the spring 12 to pull the rod 5 back along the arrow B and thereby close the throttle valve 2. Then, the engine rotational speed decreases according to the closing action of the throttle valve 2.

As described above, when the engine rotational speed Ne at engine idle is high, the ratio of the on-period (constant value) tON of the pulse signal P to the period thereof becomes larger, the negative pressure for operating the diaphragm 11 becomes larger, and accordingly the opening of the throttle valve 2 is decreased. On the contrary, when the engine rotational speed Ne at engine idle is low, the ratio of the on-period tON of the pulse signal P becomes smaller, the operating negative pressure becomes smaller, and accordingly the opening of the throttle valve 2 is increased.

When the engine is free from external loads, the solenoid valves 50 and 60 are deenergized and accordingly the vacuum-operated actuator 40 is inoperative wherein both the first and second vacuum chambers 48, 49 are in communication with the atmosphere, exerting no influence on the operation of the vacuum-operated actuator 10.

When the vacuum-operated actuator 40 is thus inoperative, proportional feedback control of the engine idling rotational speed is carried out in response to variations in the engine rotational speed so as to maintain the idling engine rotational speed Ne at a desired value.

When a power generator driven by the engine is burdened by such an external electrical load as headlights and small lights, the electrical load detector 31 detects the on-state of the external electrical load and outputs the load signal indicative thereof. When the electronic control unit 30 receives this signal from the load signal detector 31, it outputs the signal eL to thereby energize the solenoid 54 of the solenoid valve 50, whereupon the communication port 53*a* is closed and the open end 70*a* of the passage 70 is opened. As a result, the negative pressure in the intake pipe 1 is introduced into the first vacuum chamber 48 of the vacuum-operated actuator 40 via the passage 70, the chamber 51 of the solenoid valve 50, and the passage 72, whereupon the diaphragm 42 is displaced in the direction indicated by the arrow A in FIG. 1 until it is stopped by the movable stopper 44. As the diaphragm 42 is thus displaced, it pulls the rod 5 (via its extension 5') in the direction indicated by the arrow A, to thereby increase the opening of the throttle valve 2 from the opening assumed by the throttle valve 2 during engine idling operation before the external load is energized. This will be referred to as a first stage valve opening correction.

Similarly, the electronic control unit 30 also outputs the signal eL to actuate the solenoid valve 50 to thereby effect the first stage throttle valve opening correction, also when the electronic control unit 30 receives a signal from the power transmission detector 32 or from the low temperature detector 33, which is generated when the compressor of the air-conditioner is actuated, or when the automatic transmission assumes a position other than the neutral and parking positions, or when the engine cooling water temperature TW is lower than the predetermined value.

Thus, according to the invention it is not necessary to calculate the duty ratio of the control signal for on-off controlling the solenoid valve 20, nor necessary to provide expensive control devices such as a pulse motor. The control system according to the invention has a simple structure but is capable of achieving proportional feedback control of the idling speed Ne in response to the engine rotational speed.

Further, according to the invention by virtue of the use of the vacuum-operated actuator using a diaphragm and constructed to open the throttle valve by the atmospheric pressure (a first control pressure), the throttle valve can be opened to a larger degree when the engine is operating at a high altitude than when it is operating at a low altitude, since the operating negative pressure becomes smaller with a decrease in the intake pipe vacuum at such high altitude. Accordingly, it is possible to increase the idling speed at the high altitude higher than that at the low altitude and thereby stabilize the idling operation of the engine. Further, it is also possible to prevent the engine rotational speed from dropping even when the engine at idle is burdened by an external load.

While the first stage opening correction is effected by generation of the signal eL in response to actuation of the external load(s) other than the compressor of the air-conditioner, if the compressor of the air-conditioner which forms a larger external load is actuated in addition, the solenoid 64 of the solenoid valve 60 is energized to close the communication port 63*a* and open the open end 71*a* of the passage 71. Then, negative pressure prevailing in the intake pipe 1 is introduced into the second vacuum chamber 49 of the vacuum-operated actuator 40 via the passage 71, the chamber 61 of the solenoid valve 60, and the passage 73. As a result, the diaphragm 43 together with the stopper 44 is displaced in the direction A, which compels the diaphragm 42 to be displaced by the same amount and in the same direction, since at this time negative pressure is introduced into the first vacuum chamber 48 as well. As a result, a second stage opening correction is effected whereby the opening of the throttle valve 2 is further increased from the opening assumed by the valve 2 on the occasion of the first stage correction. Consequently, it is possible to correct the throttle valve opening, and hence the engine rotational speed, through two stages in response to the magnitude of loads applied on the engine during engine idling, whereby stable idling engine operation is maintained.

What is claimed is:

1. An idling speed control system for controlling idling rotational speed of an internal combustion engine having an intake passage and a throttle valve arranged therein, comprising:

vacuum-operating actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure for opening said throttle valve and a second control pressure for closing said throttle valve;

electronic control means operatively connected to said engine and said change-over control valve means, said electronic control means being adapted (i) to generate an on-off control pulse signal having a pulse repetition period corresponding to rotational speed of said engine, one of on-period and off-period of said on-off control pulse signal having a predetermined constant value, said one of said on-period and off-period causing supply of a predetermined one of said first and second control pressures to said vacuum chamber, and (ii) to supply said change-over control valve means with said on-off control pulse signal, in response to which said change-over control valve means supplies said vacuum chamber, selectively, with said first control pressure and said second control pressure; and valve opening-correcting means operatively connected to said throttle valve and being responsive to at least one predetermined external load applied on said engine for correcting to a larger opening the opening of said throttle valve which is determined by said change-over control valve means in response to said on-off control pulse signal.

2. An idling speed control system as claimed in claim 1, wherein said valve opening-correcting means comprises first means responsive to at least one first external load applied on said engine for increasing the opening of said throttle valve which is determined by said change-over control valve means, and second means responsive to at least one second external load applied on said engine which is greater than said first external load for additionally increasing the opening of said throttle valve which is determined by said first means.

3. An idling speed control system as claimed in claim 1, wherein said electronic control means is responsive to a pulse signal indicative of rotational speed of said engine for generating said on-off control pulse signal, said pulse signal indicative of rotational speed of said engine being an ignition pulse signal from said engine.

4. An idling speed control system as claimed in any one of claims 1–3, wherein said first control pressure is atmospheric pressure, and said second control pressure is negative pressure in said intake passage.

5. An idling speed control system as claimed in any one of claims 1–3, wherein said change-over control valve means comprises a frequency solenoid valve adapted to supply said first control pressure to said vacuum chamber of said vacuum-operated actuator means when deenergized by said on-off control pulse signal, and to supply said second control pressure when energized by said on-off control pulse signal.

6. An idling speed control system as claimed in claim 2, wherein said second external load is a compressor of an air-conditioner which is driven by said engine and said first external load is at least one electrical load other than said compressor.

* * * * *

UNITED STATES PATENT AND TRADEMARK OFFICE

CERTIFICATE OF CORRECTION

PATENT NO. : 4,774,920

DATED : October 4, 1988

INVENTOR(S) : Hiroshi Hasebe, Masahiko Asakura, Michio Sakaino and Yukio Miyashita It is certified that error appears in the above-identified patent and that said Letters Patent is hereby corrected as shown below:

Claim 4, Column 10, line 28: delete "one" before "of";

Claim 5, Column 10, line 32: delete "one" before "of".

Signed and Sealed this

Ninth Day of May, 1989

*Attest:*

*Attesting Officer*

DONALD J. QUIGG

*Commissioner of Patents and Trademarks*